US009443418B1

(12) United States Patent
D'Orazio

(10) Patent No.: US 9,443,418 B1
(45) Date of Patent: Sep. 13, 2016

(54) WEARABLE APPARATUS FOR INDICATING LAWFULLY ARMED INDIVIDUALS TO POLICE OFFICERS ARRIVING AT THE SCENE OF AN INCIDENT IN PROGRESS

(71) Applicant: Andrew D'Orazio, Columbus, OH (US)

(72) Inventor: Andrew D'Orazio, Columbus, OH (US)

( * ) Notice: Subject to any disclaimer, the term of this patent is extended or adjusted under 35 U.S.C. 154(b) by 0 days.

(21) Appl. No.: 14/742,609

(22) Filed: Jun. 17, 2015

(51) Int. Cl.

| | |
|---|---|
| ***G08B 5/22*** | (2006.01) |
| ***G08B 25/12*** | (2006.01) |
| ***F41A 35/00*** | (2006.01) |
| ***G08B 5/00*** | (2006.01) |

(52) U.S. Cl.
CPC ..... *G08B 25/12* (2013.01); *F41A 35/00* (2013.01); *G08B 5/00* (2013.01)

(58) Field of Classification Search
None
See application file for complete search history.

(56) References Cited

U.S. PATENT DOCUMENTS

2013/0278411 A1* 10/2013 DiBella ..... E05B 63/00 340/527

* cited by examiner

*Primary Examiner* — Adolf Dsouza
(74) *Attorney, Agent, or Firm* — Russ Weinzimmer & Associates, PC

(57) ABSTRACT

An apparatus and method is disclosed for identifying to responding police officers at a scene the individuals that are legally carrying a firearm. A wearable light source includes a light source on an exterior surface. The light source is activated when turned on by the wearer, or when permitted by the wearer to be turned on by a transmitter operated by a responding police officer that sends an activate signal that is received by the wearable light source, such as a bracelet, watch, or badge, either by a receiver incorporated into the wearable light source, or by a smart phone carried by the wearer that relays the activation command to the wearable light source.

20 Claims, 3 Drawing Sheets

WEARABLE APPARATUS FOR INDICATING LAWFULLY ARMED INDIVIDUALS TO POLICE OFFICERS ARRIVING AT THE SCENE OF AN INCIDENT IN PROGRESS

FIELD OF THE INVENTION

The present invention relates generally to law enforcement, and more particularly to communication systems and methods for helping law enforcement personnel during an incident in progress.

BACKGROUND OF THE INVENTION

In the United States, the right to own and carry a firearm is one of our most basic freedoms, guaranteed by the Constitution. As more and more people are obtaining "concealed carry" permits that allow them to wear a firearm in a concealed manner, such as tucked into a waist-band, or hidden in a pocket, there is a growing number of people who carry a concealed weapon every time they go out in public. In addition, off-duty law enforcement personnel are required to carry concealed weapons in some jurisdictions, and active undercover or plainclothes law enforcement officers also must carry a concealed weapon.

Public areas, such as sporting arenas and airports, sometimes employ substantially effective weapons-detection methods to detect individuals that are carrying a firearm so as to prevent them from entering where people are typically unarmed and unprotected. But not every public place can implement such security measures. In the event of a rogue shooter in a public place, police are always called as soon as possible, and often other armed individuals in the immediate vicinity of the shooter will also draw their gun in an effort to protect innocent lives as well as themselves.

This presents a serious problem to law enforcement officers who arrive on the scene with little knowledge of who is legitimately carrying a firearm and using it for lawful purposes, and who is using a firearm in a manner that poses a threat. While law enforcement professionals are trained to discern threatening individuals from nonthreatening individuals, deadly accidents can easily occur when there are multiple armed individuals on a scene, regardless of whether they make their intentions known to police on the scene. Thus, it is possible for a well-intended, legitimately-armed individual to be mistaken as a threat to responding police officers.

SUMMARY OF THE INVENTION

The present invention solves the problems described above by providing a wearable light source, such as a bracelet, that displays an indication that the wearer is lawfully carrying a firearm, and a method for using a wearable light source to inform police arriving on a scene that the wearer of the wearable light source is lawfully in possession of a firearm. In some embodiments, the wearer of the light source is in complete and sole control as to when the wearable light source is illuminated. In other embodiments, the wearable light source can be activated by police arriving on the scene. In further embodiments, the device can be activated by police only if permitted by the wearer, i.e., the wearer has control of whether or not the device is activated by the police arriving on the scene. In other embodiments, the device can be activated by either the police arriving on the scene, or by the wearer. Since there will be times when a wearer of the device will not want their bracelet activated, some wearers will opt to prevent the police from activating their device when the police arrive on the scene. Thus, not every wearable device will be activated when the police arrive on the scene, and consequently not every wearer of the device indicating lawful carry of a firearm will necessarily be revealed. Further, the wearable light source can indicate the status of its wearer (such as by color of the light) as being either off-duty law enforcement, plainclothes law enforcement, or someone who is not a member of law enforcement but is in legitimate possession of a weapon, such as a concealed carry permit holder.

One general aspect of the invention is a method for communicating to police officers arriving on a scene of an incident that a person at the scene is in lawful possession of a firearm The method includes, when at a scene of an incident, a person wearing a wristband that includes: at least one light source, the light source being capable of illuminating so as to indicate to the police officers at the scene that a wearer of the wristband is in lawful possession of a firearm; a battery capable of energizing the light source; and a power switch, the power switch enabling the battery to energize the light source, when at the scene of the incident, the person actuating the power switch, thereby energizing the light source using the battery, thereby indicating to the police officers at the scene that the person is in lawful possession of a firearm.

In some embodiments, the at least one light source indicates a legal status associated with the person wearing the wristband.

In some embodiments, the at least one light source displays a color, the color indicating legal status of the wearer as one of: off-duty law enforcement, plainclothes law enforcement, concealed carry permit holders, and individuals who are not members of law enforcement but are otherwise lawfully carrying a firearm.

In some embodiments, the at least one light source emits light in a repeating pattern, the repeating pattern indicating legal status of the wearer as one of: off-duty law enforcement, plainclothes law enforcement, concealed carry permit holders, and individual who is not a member of law enforcement but is lawfully carrying a firearm.

In some embodiments, the person wearing a wristband includes: the person wearing a wristwatch having at least one light source incorporated in the face of the wristwatch.

In some embodiments, the person wearing a wrist band includes instead wearing a law enforcement badge including at least one light source.

Another general aspect of the invention is a bracelet for indicating a wearer of the bracelet as being in lawful possession of a weapon. The bracelet includes: a wristband; a light source, attached to the wristband, the light source being capable of illuminating so as to indicate a wearer of the wristband as being in lawful possession of a weapon; a battery capable of energizing the light source; a power switch, connected to the light source and the battery, the power switch enabling the battery to energize the light source when the power switch is actuated.

In some embodiments, the bracelet further includes a controller, connected to the power switch, the controller being configured to operate the power switch to activate the light source; and a receiver, connected to the controller, the receiver being configured to receive an activation command that instructs the controller to actuate the power switch so as to energize the light source.

In some embodiments, the bracelet further includes: a transmitter, operatively coupled to the controller, the transmitter being configured to transmit an authentication signal to identify the wearer of the wristband.

In some embodiments, the authentication signal indicates a legal status associated with the person wearing the wearable light source. In further embodiments, the authentication signal indicates a location of the person wearing the wearable light source.

In some embodiments, the light source displays a color, the color indicating legal status of the wearer as one of the group consisting of: off-duty law enforcement, plainclothes law enforcement, and individuals who are not members of law enforcement but are lawfully carrying a weapon.

In some embodiments, the light source emits light in a repeating pattern, the repeating pattern indicating legal status of the wearer as one of the group consisting of: off-duty law enforcement, plainclothes law enforcement, and individual who is not a member of law enforcement but is lawfully carrying a weapon.

In some embodiments, the receiver is configured to receive an activation command from a smart phone.

In some embodiments, the wearable light source is attached to a wristband by being incorporated in the face of a wristwatch.

In some embodiments, a law enforcement badge is substituted for the wristband.

Another general aspect of the invention is a system for communicating lawful firearm-possession to police officers arriving on a scene. The system includes: a plurality of wearable light sources, each wearable light source being configured to receive an activation command and activate the wearable light source in response to the activation command so as to indicate that a lawfully armed individual is wearing the wearable light source; and a transmitter system configured to issue activation commands to the plurality of wearable light sources.

In some embodiments, each wearable light source includes a transmitter that is configured to transmit an identifying signal that identifies the wearer of the wearable light source, the identifying signal being transmitted by the wearable light source in response to receiving an activation command. In further embodiments, the identifying signal indicates a legal status associated with the person wearing the wearable light source. In other further embodiments, the identifying signal indicates a location of the person wearing the wearable light source.

In some embodiments, each wearable light sources include a receiver that is configured to receive activation commands from a source other than a wearer of a wearable light source. In further embodiments, each activation command is accompanied by location information of an incident in progress. In other further embodiments, each activation command causes a communication link to be established between a person wearing a wearable light source and a person not at the scene.

In some embodiments, the wearable light source is secured to a law enforcement badge.

In some embodiments, the wearable light source is included on the face of a wristwatch.

In some embodiments, the wearable light source displays a recognizable pattern of illumination.

In some embodiments, the wearable light source transmits to another user a signal indicating location information of the wearer of the wearable light source.

BRIEF DESCRIPTION OF THE DRAWINGS

Many other features and advantages of the present invention will become apparent upon reading the following detailed description, when considered in conjunction with the accompanying drawings, wherein.

DETAILED DESCRIPTION

Figure 1:
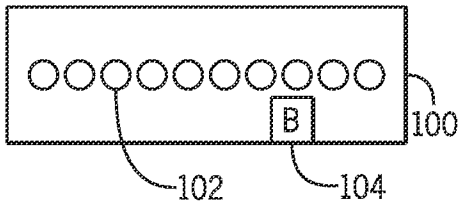
FIG. 1 is a side view of a lawful firearm-possession indication bracelet to be worn by an individual lawfully carrying a concealed firearm.

The present invention provides an apparatus and method for indicating individuals lawfully carrying firearms to responding police. As shown in FIG. 1, lawful firearm-possession indication bracelet 100 includes a light source 102 on its exterior surface, powered by a battery 104. In an embodiment, light source 102 includes a plurality of light-emitting diodes (LEDs). In the event of an active shooter situation, if the wearer of bracelet 100 wants to be visible to law enforcement or others in a manner that identifies the wearer as being in lawful possession of a firearm, the wearer activates the bracelet 100 with a switch (not shown). In one embodiment, activating the switch activates the light source 102. In another embodiment, activating the switch enables a receiver so that light source 102 can be activated by responding police. Alternatively, or additionally, the wearer of bracelet 100 can choose to NOT allow the light source 102 to emit light, but instead to allow the bracelet 100 to transmit via radio frequency an identification code that can be received by officers at the scene.

While the following description refers to a bracelet worn around the wrist, it is to be understood that in some embodiments, light source 102 is embodied on other wearable configurations, such as a necklace, a belt, a hatband, a wallet, a badge holder and the like. Similarly, light source 102 can be included in the face of a wristwatch. In yet another embodiment, light source 102 is incorporated within an elastic band that secures light source 102 around a conventional law enforcement badge. It is contemplated that in some embodiments, light source 102 is worn in a concealed manner and then displayed in an emergency situation. Also, the bracelet 100 of FIG. 1 can also be worn by members of a construction crew, and by roadside workers so as to draw more attention to their presence, and to provide greater visibility/safety while in work zones. When used in these contexts, the wearer would turn on the bracelet 100 when entering the work zone, and turn it off when leaving the work zone.

Figure 2:
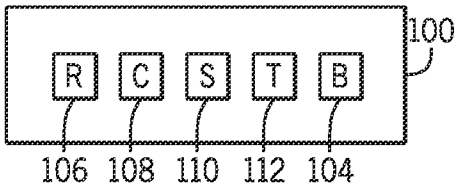
FIG. 2 is a schematic diagram of functional components included in embodiments of the bracelet of FIG. 1.

Directing attention to FIG. 2, bracelet 100 includes receiver 106 and controller 108. Receiver 106 is connected to controller 108 to receive radio frequency signals containing commands and/or data that are used by controller 108 to operate light source 102. For example, a received command may activate light source 102, and direct it to display a desired color or visual effect. In some embodiments, light source 102 may be operated to flash as a recognizable pattern such as strobe light to make the wearer more visible to responding police in an emergency situation. In other embodiments, this function is performed manually by the wearer manipulating switch 110 connected to controller 108, but only if the bracelet 100 has been authenticated via the receiver 106 and controller 108 as belonging to a person authorized to carry a firearm. In some embodiments, switch 110 includes a dual activation design that requires a user to make two separate activation operations to activate light source 102. For example, switch 110 may require the wearer to hold switch 110 down while sliding it to another position. This protects the user from accidentally activating light source 102, which may be problematic to undercover or plainclothes law enforcement.

In some embodiments, bracelet 100 can be configured to only emit a certain color, or to flash in a certain pattern, or sequence of colors, and thereby provide additional information about the wearer. For example, displayed colors can indicate status of the wearer: blue for an off-duty or plainclothes police officer, red for a non-police individual, such as a private citizen lawfully carrying a concealed handgun, and the like. In some embodiments, controller 108 is connected to transmitter 112. Transmitter 112 is configured to emit a signal when receiver 106 detects communication from transmitter system 200. In such embodiments, transmitter 112 emits a signal recognizable by transmitter system 200 to indicate the presence of a wearer of bracelet 100. In other embodiments, the emitted signal contains an identification code that uniquely identifies the wearer of bracelet 100. In some embodiments, location information obtained from a cell phone or other locating device carried by the wearer is also transmitted, and in such embodiments, receiver 106 on bracelet 100 is configured to receive this information and pass it to controller 108, which modifies the message transmitted in the emitted signal over transmitter 112. Transmitted codes are received, used, and stored by transmitter system 200, in some embodiments.

Figure 3:
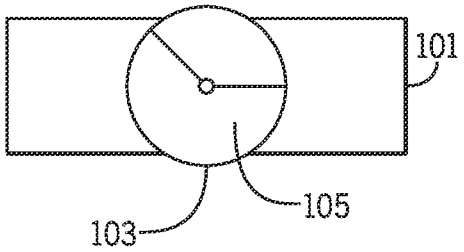
FIG. 3 is a side view of an alternate embodiment of the lawful firearm-possession indication bracelet, the bracelet including a wristwatch.

As shown in FIG. 3, the functional components of FIG. 2 can also be incorporated into an alternative bracelet 101, and can also include wristwatch 103. Wristwatch 103 includes a clock face 105 that is controllably illuminated as described above with respect to light source 102 on bracelet 100. In the description that follows, bracelet 101 can be substituted for all references to bracelet 100.

Figure 4:
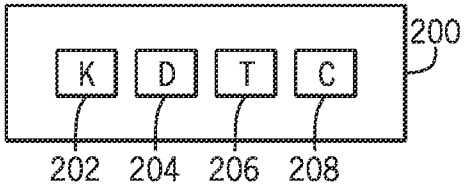
FIG. 4 is a schematic diagram of the functional components of a transmitting system that commands all lawful firearm-possession indication bracelets in the vicinity to activate and/or illuminate.

FIG. 4 illustrates a block diagram of a system in which transmitter system 200 commands indication bracelets 100 to activate and/or become illuminated. It is anticipated that in crowded conditions, where numerous people may be carrying concealed firearms, transmitter system 200 emits a signal of sufficient strength to activate all bracelets 100 at the scene. As described above, for authentication purposes, to ensure that the wearer of the bracelet is truly a nonthreatening lawful carrier of a concealed weapon, transmitter system 200 can authenticate each bracelet 100 that is equipped with its own transmitter 112 and authentication code. For example, upon arriving at the scene and being activated either by a police officer or simply programmed to periodically transmit an activation command, transmitter system 200 can also include color information that makes all bracelets 100 emit a particular color. In some embodiments, where transmitter system 200 includes receiver 202, configured to provide a voice-activated feature on transmitter system 200 that incorporates a telephone or radio carried by a police officer or other responder, and, using a microphone of a telephone or radio, the user can call out a color, such as "orange" and/or a visual effect command, such as "flash," and the commands are converted into signals passed from the cell phone or radio system to transmitter system 200 so that while searching for a rogue shooter, the user can instantly authenticate a wearer of bracelet 100 as likely NOT being the rouge shooter by calling out a change in illumination by light source 102, which would change only if the wearer was authenticated.

Transmitter system 200 can be configured in a variety of applications. For example, transmitter system 200 can be integrated into a vehicle for providing information on a display screen, or verbally via a speaker to a user immediately upon arrival on the scene, while the user is relatively protected from gun fire. Audio applications are also especially useful for wearable embodiments in which transmitter system 200 is battery-powered and worn on the user's body or clothing.

In some embodiments, transmitter system 200 maintains a database 204. Database 204 maintains associations between data such as the times and durations that transmitter system 200 received signals emitted by each bracelet 100. In some embodiments, identification and position data are stored in database 204.

Figure 5:
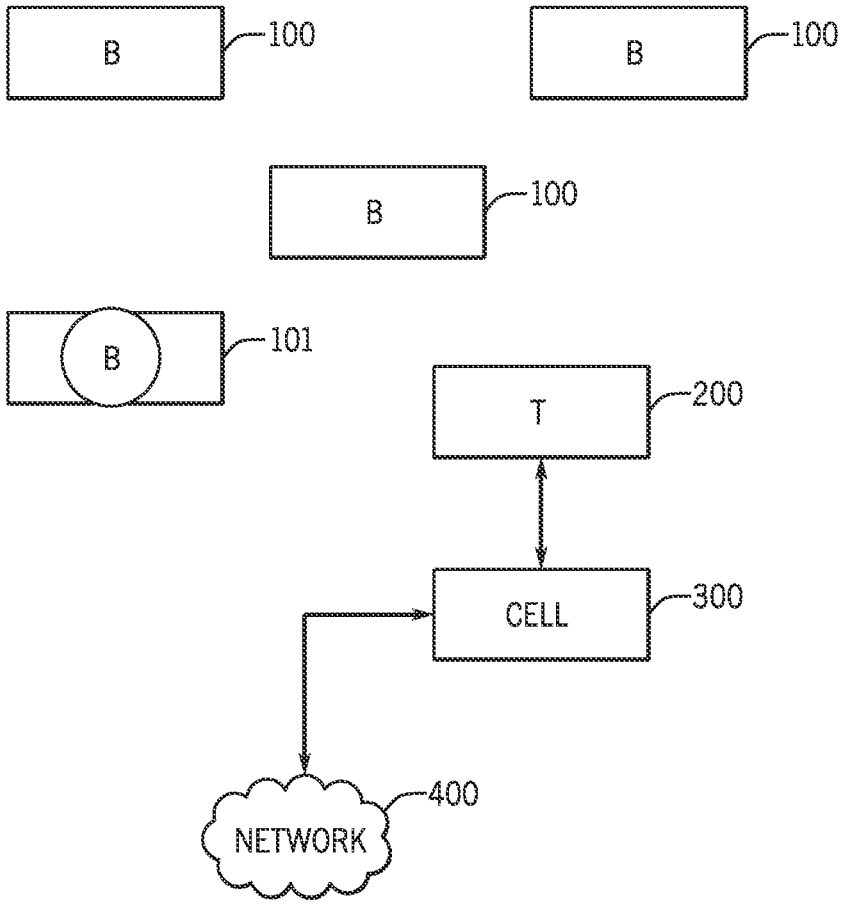
FIG. 5 is a block diagram of a plurality of lawful firearm-possession indication bracelets in communication with the transmitting system of FIG. 4, that also is in communication with a telecommunications network.

With reference to FIG. 5, transmitter system 200 also includes a communication link utilizing the cell phone or radio system 300 carried by the user of transmitter system 200. Controller 208 on transmitter system 200 can utilize this functionality and place a call over a public telecommunication network 400 or by radio to other law enforcement personnel and communicate to other people information such as the information stored in database 204.

Figure 6:
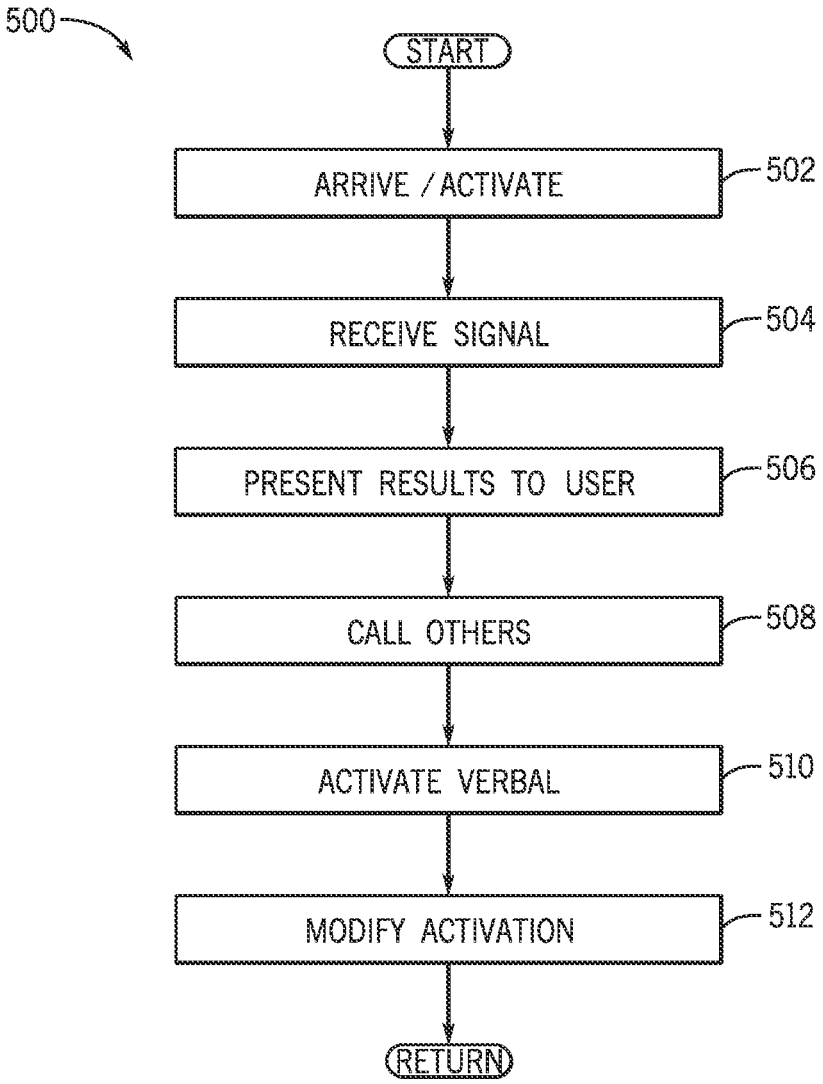
FIG. 6 if a flow diagram of a sequence of acts executed in accordance with the use of the lawful firearm-possession indication bracelet in an active shooter scenario.

FIG. 6 indicates a sequence of acts 500 executed in accordance with some embodiments of the illuminated indication bracelet in an active shooter scenario. At act 502, a user of transmitter system 200 arrives on scene and transmits an activation signal to bracelets 100 and/or 101 located nearby. At act 504, response signals are received from bracelets 100 and/or 101. At act 506, information from the received response signals is presented to the user of transmitting system 200, either visually, audibly, or both. At act 508, controller 108 initiates a call to other law enforcement personnel, such as other officers present on the scene, or a remotely-located dispatch operator. At act 510, the user activates a verbal-command mode. At act 512, in response to a verbal command issued by the user, controller 208 modifies the activate command that is then sent by transmitter system 200 to bracelets 100 and/or 101.

In some embodiments, a smart phone application interacts with bracelet 100 and/or 101 and transmitter system 200. When a wearer of the bracelet 100 and/or 101 carries a smartphone linked to transmitter system 100, signals received by the wearer's smart phone are used to activate the wearer's bracelet 100 and/or 101 and display on the smart phone the location of transmitter system 200 and/or the location of the incident in progress, such that fellow off-duty police, plainclothes or undercover law enforcement not in communication over police radio, and/or armed citizens, can be notified and respond to an incident in progress. In some embodiments, a follow-up termination signal can be sent by transmitter system 200 when the incident has ended.

While an apparatus and system has been described and illustrated in detail, it is to be understood that numerous modifications can be made to embodiments of the present invention without departing from the spirit thereof.

What is claimed is:

1. A method for communicating to police officers arriving on a scene of an incident that a person at the scene is in lawful possession of a firearm, the method comprising:

when at a scene of an incident, a person wearing a wristband that includes:

at least one light source, the light source being capable of illuminating so as to indicate to the police officers at the scene that a wearer of the wristband is in lawful possession of a firearm;

a battery capable of energizing the light source; and a power switch, the power switch enabling the battery to energize the light source, when at the scene of the incident, the person actuating the power switch, thereby energizing the light source using the battery, thereby indicating to the police officers at the scene that the person is in lawful possession of a firearm.

2. The method of claim 1, wherein the at least one light source indicates a legal status associated with the person wearing the wristband.

3. The method of claim 1, wherein the at least one light source displays a color, the color indicating legal status of the wearer as one of:

off-duty law enforcement, plainclothes law enforcement, concealed carry permit holders, and individuals who are not members of law enforcement but are otherwise lawfully carrying a firearm.

4. The method of claim 1, wherein the at least one light source emits light in a repeating pattern, the repeating pattern indicating legal status of the wearer as one of:

off-duty law enforcement, plainclothes law enforcement, concealed carry permit holders, and individual who is not a member of law enforcement but is lawfully carrying a firearm.

5. The method of claim 1, wherein the person wearing a wristband includes:

the person wearing a wrist watch having at least one light source incorporated in the face of the wristwatch.

6. The method of claim 1, wherein the person wearing a wrist band includes instead wearing a law enforcement badge including at least one light source.

7. A bracelet for indicating a wearer of the bracelet as being in lawful possession of a weapon, the bracelet comprising:

a wristband;

a light source, attached to the wristband, the light source being capable of illuminating so as to indicate a wearer of the wristband as being in lawful possession of a weapon;

a battery capable of energizing the light source; and a power switch, connected to the light source and the battery, the power switch enabling the battery to energize the light source when the power switch is actuated.

8. The bracelet of claim 7, further comprising:

a controller, connected to the power switch, the controller being configured to operate the power switch to activate the light source; and a receiver, connected to the controller, the receiver being configured to receive an activation command that instructs the controller to actuate the power switch so as to energize the light source.

9. The bracelet of claim 8, further comprising:

a transmitter, operatively coupled to the controller, the transmitter being configured to transmit an authentication signal to identify the wearer of the wristband.

10. The bracelet of claim 9, wherein the authentication signal indicates a legal status associated with the person wearing the wearable light source.

11. The bracelet of claim 7, wherein the light source displays a color, the color indicating legal status of the wearer as one of:

off-duty law enforcement, plainclothes law enforcement, and individuals who are not members of law enforcement but are lawfully carrying a weapon.

12. The bracelet of claim 7, wherein the light source emits light in a repeating pattern, the repeating pattern indicating legal status of the wearer as one of the group consisting of:

off-duty law enforcement, plainclothes law enforcement, and individual who is not a member of law enforcement but is lawfully carrying a weapon.

13. The bracelet of claim 7, wherein the wearable light source is attached to a wristband by being incorporated in the face of a wristwatch.

14. The bracelet of claim 7, wherein a law enforcement badge is substituted for the wristband.

15. A system for communicating lawful firearm-possession to police officers arriving on a scene, the system comprising:

a plurality of wearable light sources, each wearable light source being configured to receive an activation command and activate the wearable light source in response to the activation command so as to indicate that a lawfully armed individual is wearing the wearable light source; and a transmitter system configured to issue activation commands to the plurality of wearable light sources.

16. The system of claim 15, wherein each wearable light source includes a transmitter that is configured to transmit an identifying signal that identifies the wearer of the wearable light source, the identifying signal being transmitted by the wearable light source in response to receiving an activation command.

17. The system of claim 16, wherein the identifying signal indicates at least one of:

a legal status associated with the person wearing the wearable light source; and a location of the person wearing the wearable light source.

18. The system of claim 15, wherein each wearable light sources include a receiver that is configured to receive activation commands from a source other than a wearer of a wearable light source.

19. The system of claim 18, wherein each activation command is accompanied by location information of an incident in progress.

20. The system of claim 18, wherein each activation command causes a communication link to be established between a person wearing a wearable light source and a person not at the scene.

* * * * *